US009144144B2

(12) United States Patent
Clavenna, II et al.

(10) Patent No.: US 9,144,144 B2
(45) Date of Patent: Sep. 22, 2015

(54) METHOD AND APPARATUS FOR PROVIDING A NETWORK BASED SURROUND-LIGHT ENVIRONMENT

(71) Applicant: Verizon Patent and Licensing Inc., Basking Ridge, NJ (US)

(72) Inventors: Robert A. Clavenna, II, Lucas, TX (US); Steven T. Archer, Dallas, TX (US); Kristopher Pate, Flower Mound, TX (US); Paul V. Hubner, McKinney, TX (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 18 days.

(21) Appl. No.: 14/039,482

(22) Filed: Sep. 27, 2013

(65) Prior Publication Data

US 2015/0091473 A1 Apr. 2, 2015

(51) Int. Cl.
*H05B 37/02* (2006.01)

(52) U.S. Cl.
CPC ..... *H05B 37/0272* (2013.01); *H05B 37/0227* (2013.01)

(58) Field of Classification Search
CPC ..... H05B 37/02; F21V 14/02; F21V 23/0471
USPC ..... 315/149, 152, 297
See application file for complete search history.

(56) References Cited

U.S. PATENT DOCUMENTS

| | | | | |
|---|---|---|---|---|
| 2002/0089722 | A1* | 7/2002 | Perkins et al. | 359/155 |
| 2011/0298379 | A1* | 12/2011 | Jung et al. | 315/149 |
| 2012/0112668 | A1* | 5/2012 | Van de Sluis et al. | 315/312 |
| 2012/0206050 | A1* | 8/2012 | Spero | 315/152 |
| 2013/0088154 | A1* | 4/2013 | Van Hoof et al. | 315/152 |

* cited by examiner

*Primary Examiner* — Don Le

(57) ABSTRACT

A method, apparatus, and user interface for providing a network based surround-light environment to dynamically drive lighting scenes are described. Location information of one or more illuminating elements relative to a display for presenting media information is determined. Lighting characteristic information for the one or more illuminating elements is determined. And a lighting profile for illuminating the one or more illuminating elements based on the location information and lighting characteristic information is determined.

18 Claims, 9 Drawing Sheets

300

METHOD AND APPARATUS FOR PROVIDING A NETWORK BASED SURROUND-LIGHT ENVIRONMENT

BACKGROUND INFORMATION

Consumer lighting now includes individual illuminating elements (e.g., light-emitting diode (LED) lights, screen and indicator lights of tablets, computers, and mobile telephones, etc.) that are capable of internet protocol (IP) communication and control. Furthermore, many such illuminating elements are multi-color selectable and have a selectable range of lumen intensity. However, such individual illuminating elements commonly lack a control system to dynamically drive lighting scenes. By way of example, users frequently manually control individual illuminating elements for a presentation of media information (e.g., video, pictures, sound, etc.) by a set-top box. With the vast variety of media content delivery mechanisms, traditional techniques for driving lighting scenes have become inadequate.

Therefore, there is a need for an approach to provide a network based surround-light environment to dynamically drive lighting scenes.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DESCRIPTION OF THE PREFERRED EMBODIMENT

A preferred apparatus, method, user interface, and system for providing a network based surround-light environment are described. In the following description, for the purposes of explanation, numerous specific details are set forth in order to provide a thorough understanding of the preferred embodiments of the invention. It is apparent, however, that the preferred embodiments may be practiced without these specific details or with an equivalent arrangement. In other instances, well-known structures and devices are shown in block diagram form in order to avoid unnecessarily obscuring the preferred embodiments of the invention.

Figure 1:
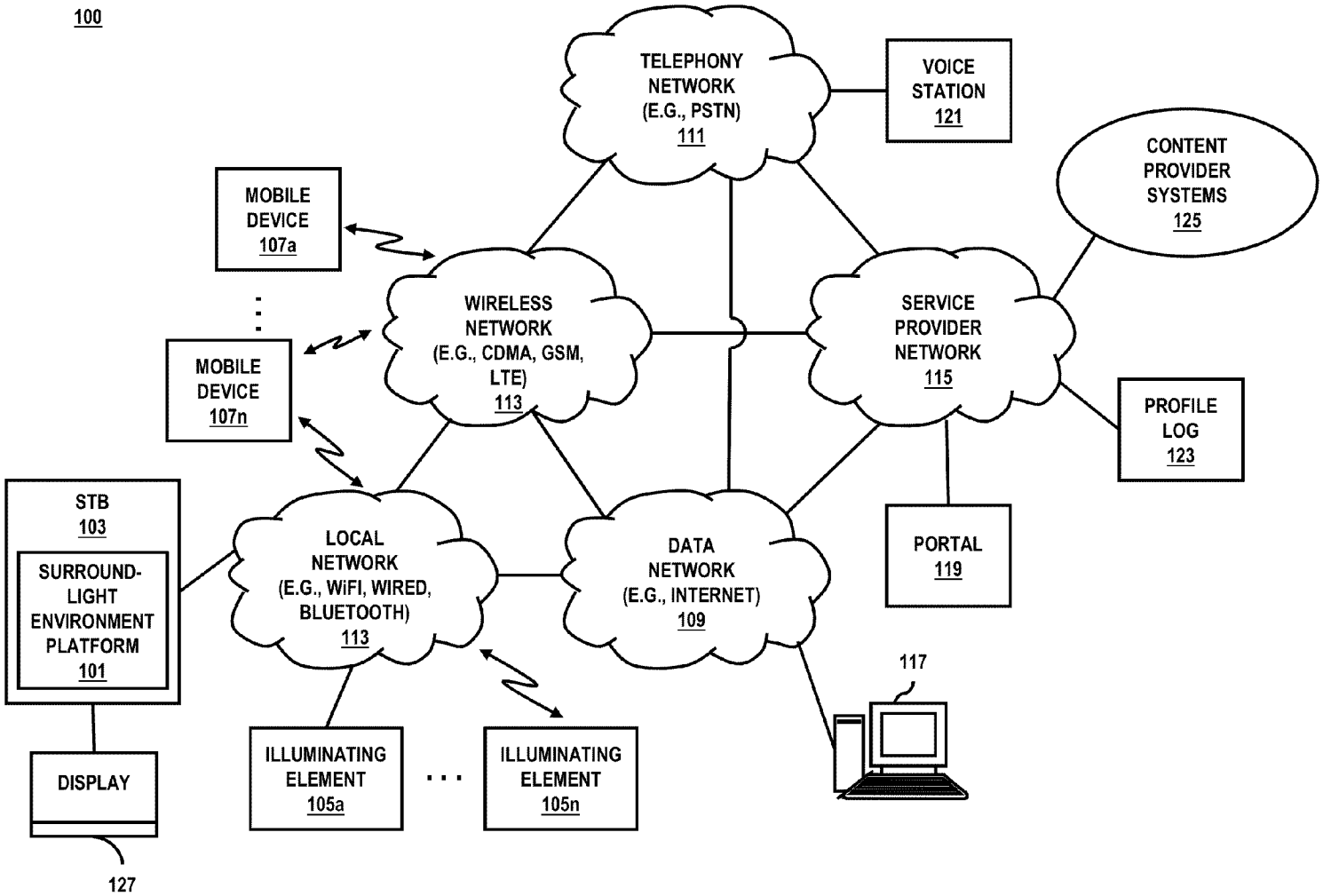
FIG. 1 is a diagram of a system capable of providing a network based surround-light environment, according to one embodiment.

FIG. 1 is a diagram of a communication system capable of providing a network based surround-light environment, according to various embodiments. For illustrative purposes, system 100 is described with respect to a surround-light platform 101. In this example, the platform 101 is included in a set-top box 103 to control illuminating elements 105 and illuminating elements (e.g., LCD displays, indicator LEDs, etc.) of mobile devices 107. The platform 101 may connect to the illuminating elements 105 and mobile devices 107 using any form of communication, such as, for example, a near field communication (NFC), BLUETOOTH, WIFI, and WIMAX.

In certain embodiments, users (e.g., subscribers) may utilize a computing device 117 (e.g., laptop, desktop, web appliance, netbook, etc.) to access platform 101 or profile log 123 via service provider portal 119. Service provider portal 119 provides, for example, a web-based user interface to allow users to access the services of platform 101.

According to one embodiment, network based surround-light environment may be part of managed services supplied by a service provider as a hosted or subscription-based service made available to users of the set-top box (STB) 103 through a service provider network 115. As shown, platform 101 may be a part of or connected to the service provider network 115. According to another embodiment, at least a portion of platform 101 may be included within or connected to the mobile devices 107.

As mentioned, consumer lighting now includes individual illuminating elements capable of IP communication and control. Furthermore, many such illuminating elements are multi-color selectable and have a selectable range of lumen intensity. However, such individual illuminating elements commonly lack a control system capable of accounting for location information of illuminating elements or for lighting characteristic information of the illuminating elements (e.g., color range, lumen intensity, delay, etc.). Thus, such control systems are unable to dynamically drive lighting scenes, for example, based on a presentation of media information (e.g., video, music, etc.) on display 127. As such, illuminating elements 105 are commonly controlled separately from the platform 101 (and set-top box 103) and controlled without regard to functions performed by the display 127.

Therefore, there is a need for an approach to provide a network based surround-light environment to dynamically drive lighting scenes. By way of example, the set-top box 103 may be configured to control illuminating elements 105 to flicker on during an output of a sudden loud sound for a video displayed on the display 127, or control some of the illuminating elements 105 to display a red color corresponding to a sunset displayed on display 127.

To address this issue, the system 100 of FIG. 1 introduces the capability to determine a lighting profile for illuminating elements 105 and/or illuminating elements of mobile devices 107. Additionally, the platform 101 (and STB 103) can be configured to determine one or more lighting parameters (e.g., lumen intensity, color, delay, etc.) for illumination of the illuminating elements 105 based on the lighting profile. The platform 101 (and STB 103) may be further configured to determine the one or more lighting parameters based further on media information associated with display 127, for instance, images presented on the display 127, images and/or sound input and/or output to/from display 127, sound related to images presented on display 127, and the like.

Although various exemplary embodiments are described with respect to STB 103, it is contemplated that these embodiments have applicability to any device capable of processing audio-video (AV) signals for presentation to a user, such as a home communication terminal (HCT), a digital home communication terminal (DHCT), a stand-alone personal video recorder (PVR), a television set, a digital video disc (DVD) player, a video-enabled phone, an AV-enabled personal digital assistant (PDA), and/or a personal computer (PC), as well as other like technologies and customer premises equipment (CPE). Furthermore, although the STB is explained in the context of playback of visual media (e.g., TV shows, movies, news, sporting events, etc.), it is contemplated that other media relating to various sources and types (e.g., audio books, cached web pages, web cast, etc.) are applicable.

As used herein, illuminating elements 105 may be any type of illuminating element including a display on a mobile device 107, an indicator (e.g., LED) on a mobile device 107, display 127, an IP enabled light, and the like. It is noted that the illuminating elements 105 may comprise various lighting technologies, such as, for example, LCD, LED, plasma, red-green-blue (RGB) bulb, incandescent, etc., and thus may have various lighting characteristics, such as, for example, a color range, maximum and/or minimum lumen intensity, delay of reaction, frequency, and the like.

As used herein, mobile devices 107 may be any type of mobile terminal including a mobile handset, mobile station, mobile unit, multimedia computer, multimedia tablet, communicator, netbook, Personal Digital Assistants (PDAs), smartphone, media receiver, etc. It is also contemplated that the mobile devices 107 may support any type of interface for supporting the presentment or exchange of data. In addition, mobile devices 107 may facilitate various input means for receiving and generating information, including touch screen capability, keyboard and keypad data entry, voice-based input mechanisms, accelerometer (e.g., shaking the mobile device 107), and the like. Any known and future implementations of mobile devices 107 are applicable. It is noted that, in certain embodiments, the mobile devices 107 may be configured to transmit information (e.g., audio signals, words, address, etc.) using a variety of technologies—e.g., NFC, BLUETOOTH, infrared, etc. Also, connectivity may be provided via a wireless local area network (LAN). By way of example, a group of mobile devices 107 may be configured to a common LAN so that each device can be uniquely identified via any suitable network addressing scheme. For example, the LAN may utilize the dynamic host configuration protocol (DHCP) to dynamically assign "private" DHCP internet protocol (IP) addresses to each mobile device 107, e.g., IP addresses that are accessible to devices connected to the service provider network 115 as facilitated via a router.

In some embodiments, platform 101, the STB 103, and other elements of the system 100 may be configured to communicate with content provider systems 125. The content provider systems 125 may include media or programming content, such as, for instance, audio-visual content (e.g., broadcast television programs, VOD programs, pay-per-view programs, IPTV feeds, DVD related content, etc.), pre-recorded media content, data communication services content (e.g., commercials, advertisements, videos, movies, songs, images, sounds, etc.), Internet services content (streamed audio, video, or pictographic media), and/or any other equivalent media form. In this manner, the STB 103 may provide (in addition to the subscribers own content) content obtained from other sources, such as one or more television broadcast systems, one or more third-party content provider systems, as well as content available via one or more packet-based networks 109 or telephony networks 111, etc.

In some embodiments, platform 101, the mobile devices 107, the STB 103, and other elements of the system 100 may be configured to communicate via the service provider network 115. According to certain embodiments, one or more networks, such as the data network 109, the telephony network 111, and/or the wireless network 113, may interact with the service provider network 115. The networks 109-115 may be any suitable wireline and/or wireless network, and be managed by one or more service providers. For example, the data network 109 may be any local area network (LAN), metropolitan area network (MAN), wide area network (WAN), the Internet, or any other suitable packet-switched network, such as a commercially owned, proprietary packet-switched network, such as a proprietary cable or fiber-optic network. For example, computing device 117 may be any suitable computing device, such as a VoIP phone, skinny client control protocol (SCCP) phone, session initiation protocol (SIP) phone, IP phone, personal computer, softphone, workstation, terminal, server, etc. The telephony network 111 may include a circuit-switched network, such as the public switched telephone network (PSTN), an integrated services digital network (ISDN), a private branch exchange (PBX), or other like network. For instance, voice station 121 may be any suitable plain old telephone service (POTS) device, facsimile machine, etc. Meanwhile, the wireless network 113 may employ various technologies including, for example, code division multiple access (CDMA), long term evolution (LTE), enhanced data rates for global evolution (EDGE), general packet radio service (GPRS), mobile ad hoc network (MANET), global system for mobile communications (GSM), Internet protocol multimedia subsystem (IMS), universal mobile telecommunications system (UMTS), etc., as well as any other suitable wireless medium, e.g., microwave access (WiMAX), wireless fidelity (WiFi), satellite, and the like.

Although depicted as separate entities, the networks 109-115 may be completely or partially contained within one another, or may embody one or more of the aforementioned infrastructures. For instance, the service provider network 115 may embody circuit-switched and/or packet-switched networks that include facilities to provide for transport of circuit-switched and/or packet-based communications. It is further contemplated that the networks 109-115 may include components and facilities to provide for signaling and/or bearer communications between the various components or facilities of the system 100. In this manner, the networks 109-115 may embody or include portions of a signaling system 7 (SS7) network, Internet protocol multimedia subsystem (IMS), or other suitable infrastructure to support control and signaling functions.

In certain embodiments, platform 101 may include or have access to scene profiles in a profile log 123, which may be a network and/or cloud sever managed by, for example, service provider network 115. A scene profile may include lighting characteristic information for each of the illuminating elements, and a respective location relative to display 127. Additionally, a scene profile may be associated with a user name (and password), mobile device number (MDN), e-mail, STB (e.g., 103), and the like.

While specific reference will be made thereto, it is contemplated that the system 100 may embody many forms and include multiple and/or alternative components and facilities.

Figure 2:
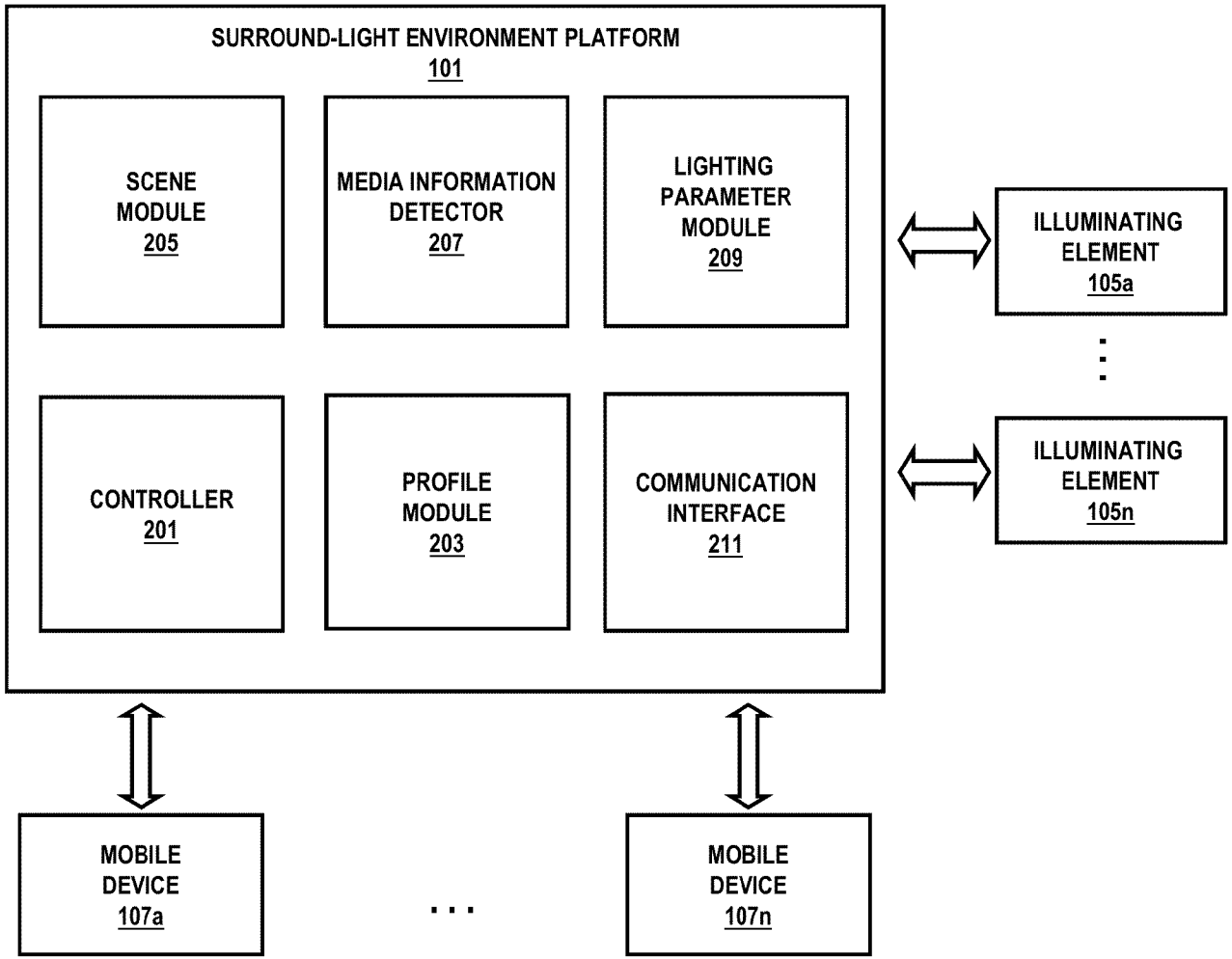
FIG. 2 is a diagram of the components of a network based surround-light environment platform, according to one embodiment.

FIG. 2 is a diagram of the components of platform 101, according to one embodiment. The platform 101 may comprise computing hardware (such as described with respect to FIGS. 6, 8, and 9), as well as include one or more components configured to execute the processes described herein for presenting item information before a checkout process. It is contemplated that the functions of these components may be combined in one or more components or performed by other components of equivalent functionality. In one implementation, platform 101 includes a controller 201, profile module 203, scene module 205, media information detector 207, lighting parameter module 209, and communication interface 211.

The controller 201 may execute at least one algorithm for executing functions of platform 101. For example, the controller 201 may interact with the communication interface 211 to obtain profile information from a remote log (e.g., profile log 123). The controller 201 may interact with the STB 103 and media streams to cause, for instance, media information detector 207 to determine lighting parameters for the illuminating elements 105 and interact with the illuminating elements 105 to cause illuminating elements 105 to illuminate according to the determined lighting parameters.

The profile module 203 determines and/or maintains a log of capabilities of illuminating elements 105. In some embodiments, such capabilities include color range and/or color temperature, a range, maximum, minimum or combination thereof of a lumen intensity and/or brightness, frequency, delay of reaction and/or activation time, or a combination thereof.

In one embodiment, the profile module 203 initiates a detection of an illumination of an illuminating element. By way of example, the profile module 203 causes mobile device 107*a* to capture, using a built-in camera, a response of illuminating element 105*a* and determines parameters (e.g., color range, maximum lumen intensity, etc.) for the mobile device 107*a*. In another embodiment, the profile module 203 initiates an input of an indication of a selection of parameters. By way of example, the profile module 203 causes mobile device 107*a* and/or STB 103 to prompt a user to enter information (e.g., model number, make, type of technology, etc.) identifying illuminating element 105*a*, and the profile module 203 works with the communication interface to determine capabilities based on the information. In another example, the profile module 203 causes mobile device 107*a* and/or STB 103 to prompt a user to enter parameter information (e.g., color range, lumen intensity, etc.) and the profile module 203 associates the entered capabilities with illuminating element 105*a*.

The profile module 203 additionally determines a location of each of the illuminating elements 105 with respect to a display (e.g., 127). For instance, the profile module 203 causes mobile device 107*a* and/or STB 103 to prompt a user to enter location information, such as, for example, a relative distance, a measured distance, an orientation relative to a viewing surface of display 127, etc. and the profile module 203 associates the entered location with illuminating element 105*a*.

The scene module 205 identifies a scene based on a profile. By way of example, the scene module 205 receives a profile maintained by profile module 203 and maps each illuminating element 105 to a portion of a viewing surface of display 127. It is noted that in some embodiments portions may be mapped to no, one, or more than one illuminating elements. Further, in some embodiments, illuminating elements (e.g., 105) are mapped to no, one, or more than one portions of a viewing surface of display 127.

Media information detector 207 samples media information associated with a display to determine lighting parameters of the illuminating elements 105. In one embodiment, the detector 207 samples an image and/or audio signal of a presentation of media information associated with a display and maps the sampled image and/or audio signal to determine lighting parameters.

As used herein, media information may include, for example, a video, an image, audio, a telephone connection, or a combination thereof from various sources of content. In some embodiments, such media information includes at least one of: audio-visual content (e.g., broadcast television programs, digital video recorder (DVR) content, on-demand programs, pay-per-view programs, IPTV (Internet Protocol Television) feeds, DVD related content, etc.), pre-recorded media content (e.g., via a personal computer, camera, etc.), data communication services content (e.g., commercials, advertisements, videos, movies, songs, audio books, etc.), Internet-based content (e.g., streamed video, streamed audio), and telephone connection (e.g., via wireless network 113, telephony network 111, local network 113, data network 109, etc.).

The detector 207 may additionally perform one or more of the following steps: (1) determine another image and/or audio signal of the presentation of the media information, (2) determine another mapping of the other image and/or audio signal, and (3) compare the mapping with the other mapping. The detector may further determine a time weighted average, change in intensity, color graduation, global screen shift, or combination thereof based on the comparison. By way of example, detector 207 samples and maps first and second images of a picture slide show displayed on display 127 and compares changes (e.g., intensity, color, global screen shift, etc.) from the first and second images with thresholds for a time weighted average, a change in intensity, color graduation, global screen shifts.

Lighting parameter module 209 determines lighting parameters to cause a dynamic illumination of the illuminating elements 105. The lighting parameter module 209 may determine, for instance, a color and/or color range, lumen intensity, delay of reaction, or a combination thereof. It is noted that some lighting parameters may be statically set for one or more illuminating elements.

In one embodiment, the lighting parameter module 209 determines an illumination of the illuminating elements 105 based on one or more of the following: (1) capabilities of each of the illuminating elements 105 from the profile module 203, (2) a scene mapping from scene module 205, and an (3) indication of changes (e.g., change in intensity, color graduation, global screen shifts, etc) from detector 207.

In some embodiments, the lighting parameter module 209 determines a lumen intensity and/or brightness based on a relative distance to a primary screen. For example, the lighting parameter module 209 selects a higher lumen intensity and/or brightness as an illuminating element 105 is positioned closer to a primary display.

In some embodiments, the lighting parameter module 209 utilizes a mapping (from scene module 205) to determine lighting parameters. By way of example, the lighting parameter module 209 selects illuminating elements 105 corresponding to a portion of display 127. Additionally, the lighting parameter module 209 selects illuminating elements 105 associated with portions of the display 127 selected by the detector 207. For example, the detector 207 determines a color graduation between samples of a particular portion that exceeds a threshold and the lighting parameter module 209 determines lighting parameters for the illuminating elements associated with the particular portion. In one embodiment, the lighting parameter module 209 determines lighting parameters for illuminating elements regardless of a mapping. For example, the lighting parameter module 209 triggers an illuminating element (e.g., an incandescent floor lamp in the back of the room) whenever a rapid dark-to-light and/or light-to-dark flash occurs across an entire presentation on the display 127.

In certain embodiments, the lighting parameter module 209 utilizes audio parameters to determine lighting parameters. Such audio parameters may include, for instance, tone, volume, intensity change, rhythm, meter, and the like. For example, the lighting parameter module 209 determines a color and/or color pattern for one or more of the illuminating elements according to audio parameters detected by the detector 207.

The platform 101 may further include a communication interface 211 to communicate with other components of platform 101, the mobile devices 107, and other components of the system 100. The communication interface 211 may include multiple means of communication. For example, the communication interface 211 may be able to communicate over short message service (SMS), multimedia messaging service (MMS), internet protocol, instant messaging, voice sessions (e.g., via a phone network), e-mail, NFC, QR code, or other types of communication. Additionally, communication interface 211 may include a web portal (e.g., service provider portal 119) accessible by, for example, mobile device 107, STB 103, computing device 117, and the like.

It is contemplated that to prevent unauthorized access, platform 101 may include an authentication identifier when transmitting signals to and from mobile devices 107 and to and from STB 103. For instance, control messages may be encrypted, either symmetrically or asymmetrically, such that a hash value can be utilized to authenticate received control signals, as well as ensure that those signals have not been impermissibly alerted in transit. As such, communications between the mobile devices 107 and platform 101 and between STB 103 and platform 101 may include various identifiers, keys, random numbers, random handshakes, digital signatures, and the like.

Figure 3:
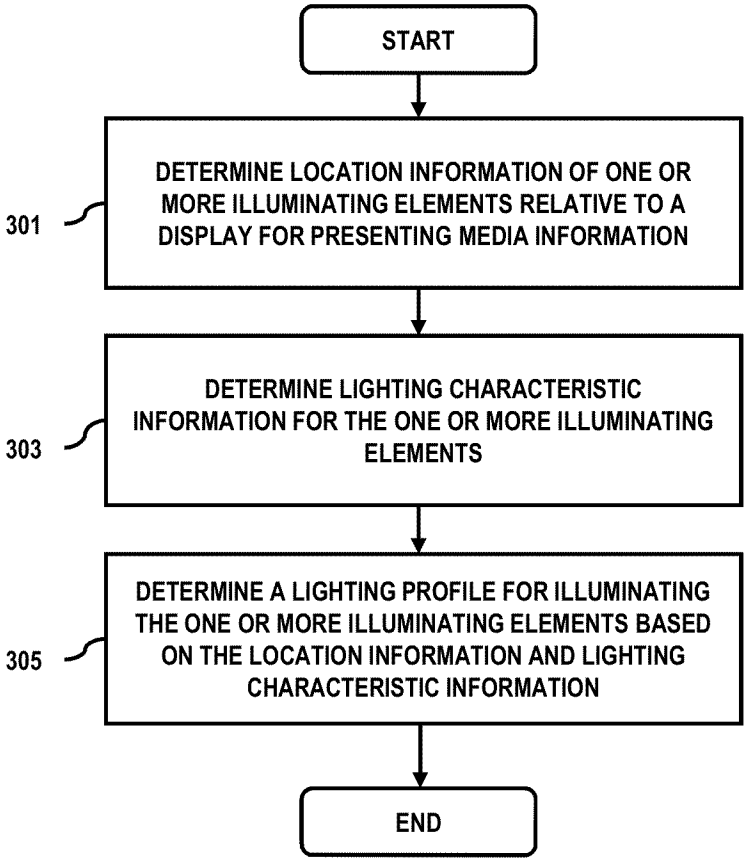
FIG. 3 is a flowchart of a process for providing a network based surround-light environment, according to one embodiment.
Figure 4:
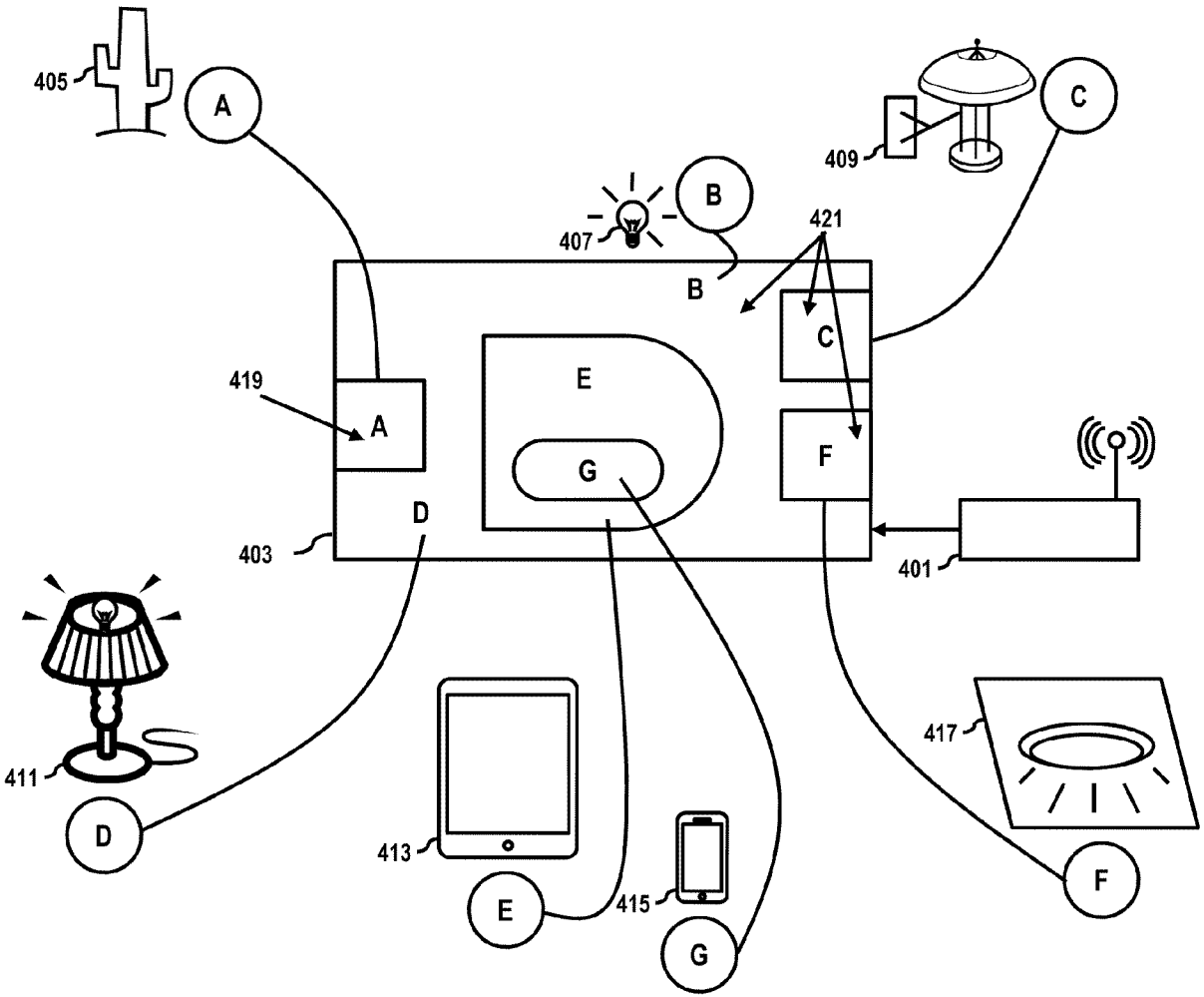
FIG. 4 is an illustration of system of a network based surround-light environment, according to one embodiment.
Figure 8:
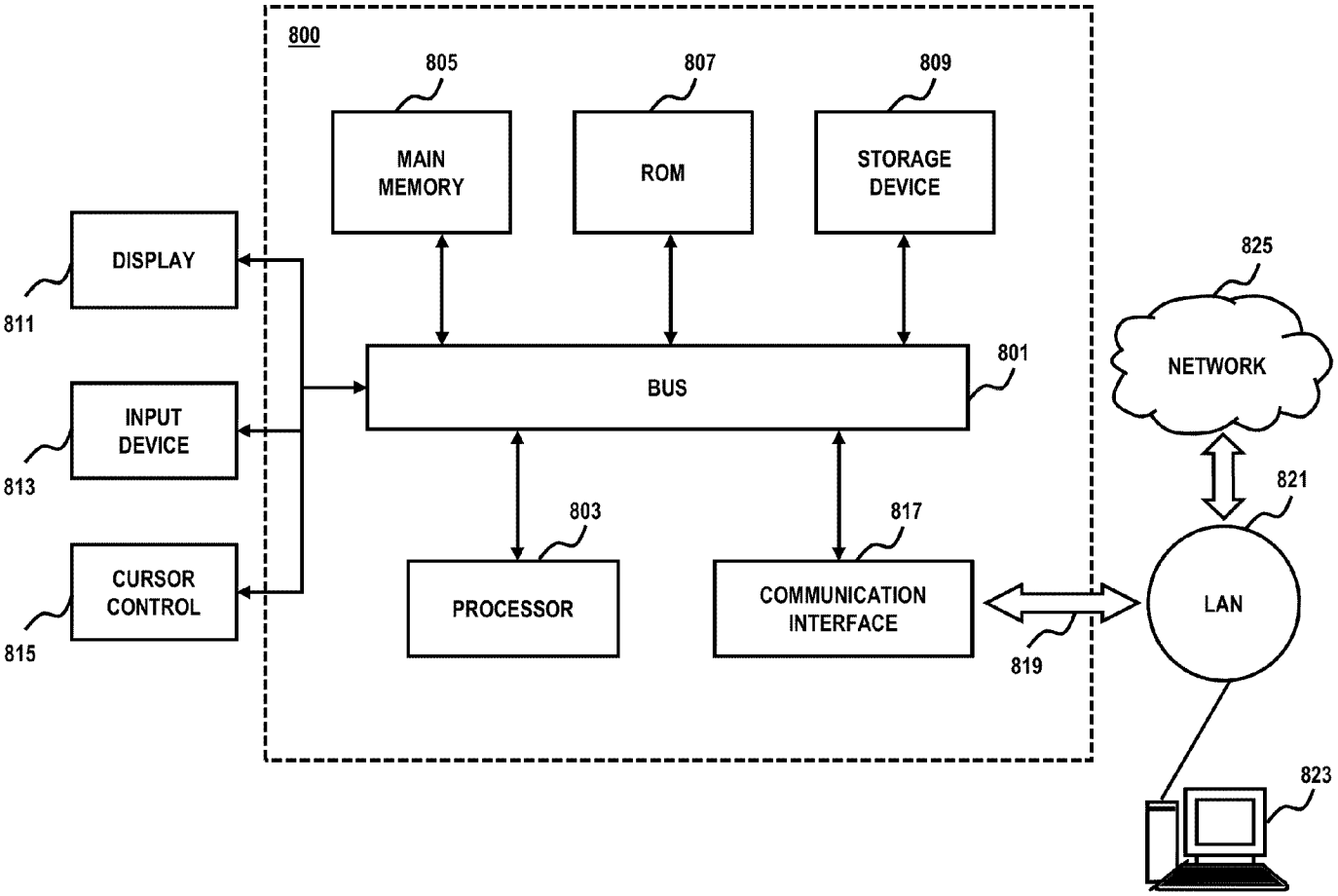
FIG. 8 is a diagram of a computer system that can be used to implement various exemplary embodiments.
Figure 9:
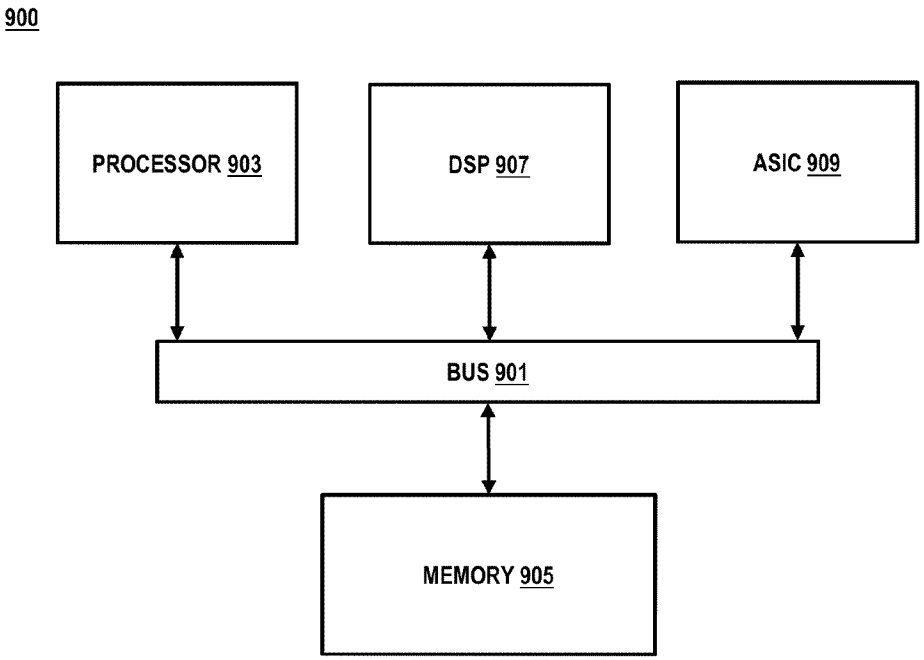
FIG. 9 is a diagram of a chip set that can be used to implement various exemplary embodiments.

FIG. 3 is a flowchart of a process for providing a network based surround-light environment, according to one embodiment. By way of example, process 300 is explained with respect to system 100 of FIG. 1, platform 101 of FIG. 2, and an exemplary system of FIG. 4. Also, process 300 may be implemented in, for instance, a chip set including a processor and a memory as shown in FIGS. 8 and 9.

In step 301, the profile module 203 determines location information of illuminating elements relative to a display for presenting media information. In one embodiment, the profile module 203 initiates an input by a user indicating the location information. Adverting to FIG. 4, the profile module 203 initiates a presentation on a main display 403 and/or on mobile device 413 of a request for an input into STB 401 of locations of available illuminating elements and determines an input by a user indicating positions of illuminating elements of neon wall art 405, a red-green-blue (RGB) lamp 407 positioned on the back of the display 403, a wall sconce 409 with a compact fluorescent (CFL) light bulb, incandescent table lamp 411, computing tablet 413 (e.g., indicator LED, and LCD screen), mobile telephone 415, and a ceiling canister 417 with a dimmer.

Next in step 303, the profile module 203 determines lighting characteristic information for the illuminating elements. In one embodiment, the profile module 203 initiates an input by a user indicating the lighting characteristics. For example, the profile module 203 determines a color, delay, and lumen intensity for the neon wall art 405 by determining a user input indicating a type of illuminating element as "neon" along with a color as "red" and performing a table look up for the type and color in a database, for instance, log 123 on service provider network 115. In another example, the profile module 203 determines a color range and lumen intensity range for the RGB lamp 407 by determining an input indicating a brand and model number for the RGB lamp 407 and/or display 403 and sending a request to the service provider network 115 for a color range and lumen intensity range based on the brand and model. In yet another example, the profile module 203 determines a lumen intensity for the incandescent table lamp 411 directly from a user input selecting a "60 Watt incandescent light bulb." In another example, a built-in camera of computing tablet 413 is used to detect a range of lumen intensity of ceiling canister 417 while a user adjusts the dimmer and the profile module 203 determines a lumen range for the canister 417 according to the detection. It is noted that the built-in camera of computing tablet 413 may determine other various lighting characteristic information, for example, a color, a color range and/or color temperature (e.g., a color map), a frequency, a delay of reaction and/or activation time, and the like.

The profile module 203 then, in step 305, determines a lighting profile for illuminating the illuminating elements based on the location information and the lighting characteristic information. In one embodiment, the profile module 203 creates a scene indicating a location of each of the illuminating elements 405 through 417, and lighting characteristic information of each respective illuminating element. The scene may be saved and/or maintained in various logs, for instance, a log within STB 401, a log of platform 101, a server and/or cloud based log, and the like.

Figure 5:
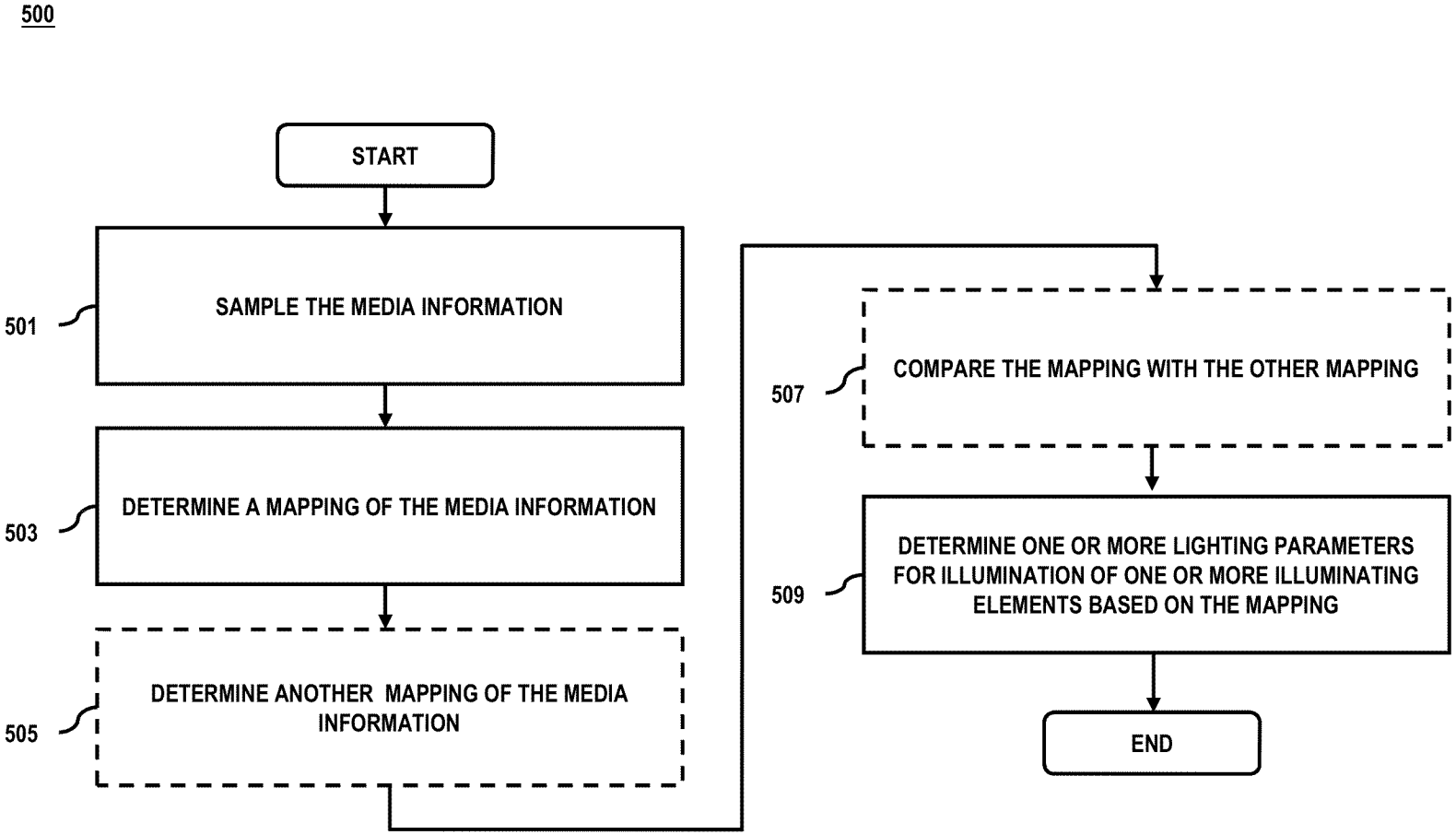
FIG. 5 is another flowchart of a process for providing a network based surround-light environment, according to one embodiment.

FIG. 5 is a flowchart of another process for providing a network based surround-light environment, according to one embodiment. By way of example, process 500 is explained with respect to system 100 of FIG. 1, platform 101 of FIG. 2, and an exemplary system of FIG. 4. Also, process 500 may be implemented in, for instance, a chip set including a processor and a memory as shown in FIGS. 8 and 9.

In step 501, the media information detector 207 samples media information. For example, the STB 401 samples a video and/or audio signal to be presented on the display 403. Next, in step 503, the scene module 205, determines a mapping of the media information. For example, the scene module 205 determines the sampled portion indicates a change or presentation corresponding to a portion 419 of the display 403 that corresponds with neon wall art 405.

The media information detector 207 and scene module 205 may similarly work together to optionally, in step 505 determine another mapping of the media information. For example, the detector 207 determines another video and/or audio signal to be presented on the display 403 and scene module 205 determines the other sampled portion indicates another change or presentation corresponding to a portion 419 of the display 403 that corresponds with neon wall art 405. Next, the lighting parameter module 209 optionally compares, as in step 507, the mapping with the other mapping. For example, the mapping and the other mapping are compared to determine a time weighted average, change in intensity, color graduation, global screen shift, or combination thereof.

The lighting parameter module 209 then, in step 509, determines lighting parameters for illumination of the one or more illuminating elements based on the mapping. In some embodiments, the lighting parameters are further based on a lighting profile. By way of example, the lighting parameter module 209 causes the neon wall art 405 to turn-on when the mapping indicates a presentation in the portion 419 of a red color (e.g., a sunset). In another example, the lighting parameter module 209 causes the RGB lamp 407, a wall sconce 409, ceiling canister 417 to turn-on when the mapping indicates a presentation in the portions 421 of sudden change in intensity (e.g., between adjacent frames, within a second, etc.).

In one embodiment, the lighting parameter module 209 selects a turn-on delay, for instance, the lighting parameter module 209 adds a delay to turn-on the RGB lamp 407 and wall sconce 409, such that the ceiling canister 417 (which has a turn-on delay greater than the RGB lamp 407 and wall sconce 409) turns on with the RGB lamp 407 and wall sconce 409. Additionally, or alternatively, the lighting parameter module 209 selects a lumen intensity for one illuminating element based on the lighting parameters, for example, the lighting parameter module 209 selects a lumen intensity for the ceiling canister 417 and the RGB lamp 407 to correspond to a lumen intensity of the wall sconce 409 (which, in the example, has a fixed lumen intensity).

Figure 6:
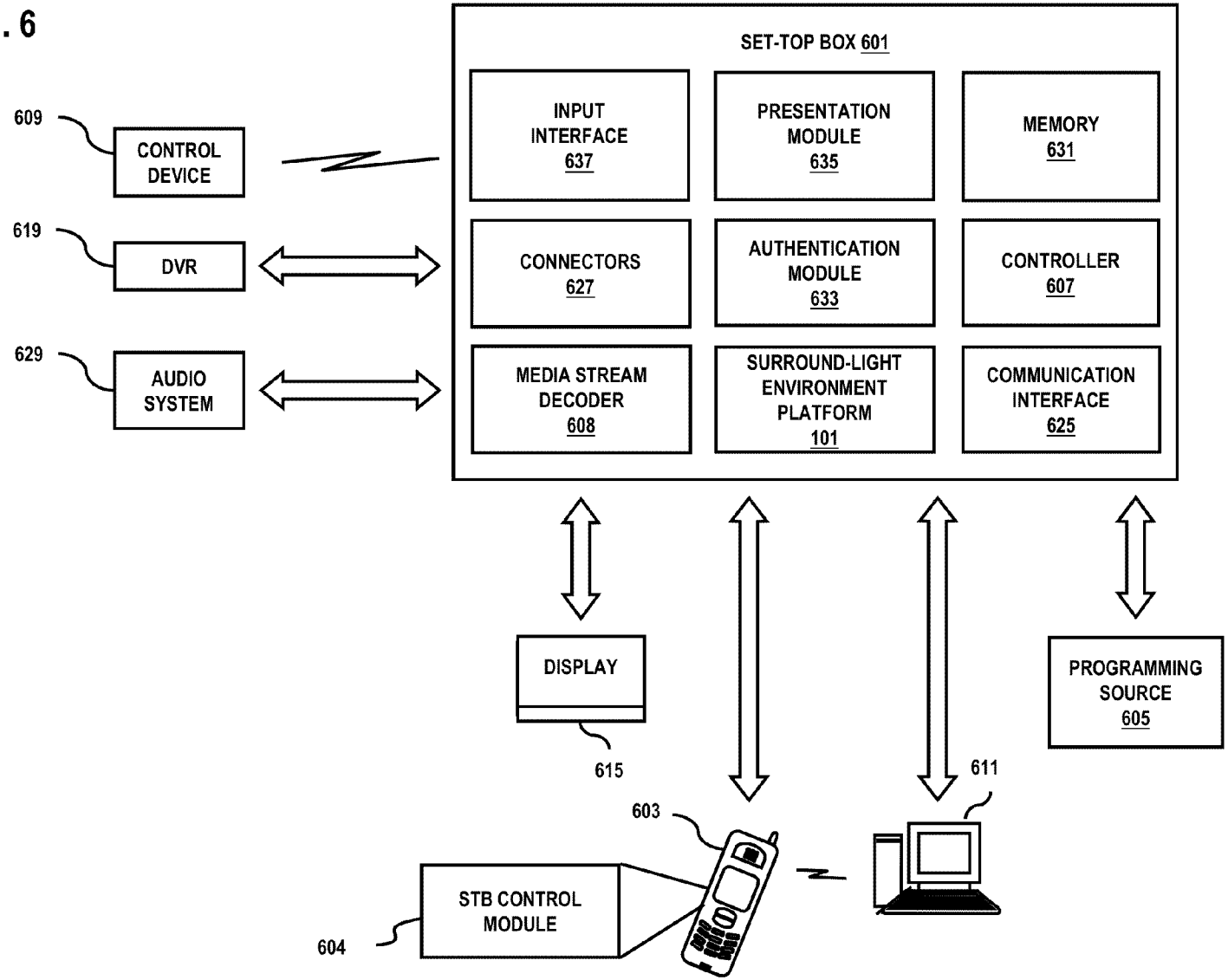
FIG. 6 is a diagram of a set-top box configured to provide a network based surround-light environment, according to one embodiment.

FIG. 6 is a diagram of a set-top box configured to provide a network based surround-light environment, according to an exemplary embodiment. STB 601 may utilize any suitable technology to receive media from user device 603 (e.g., mobile phone), as well as one or more media (or content) streams from, for example, content provider systems 125 of FIG. 1. In this example, user device 603 includes an STB control module 604 to generate and forward sensor events to STB 601. STB control module 604 communicates with various sensors (e.g., a gyroscope, accelerometer, light sensor, proximity sensor, temperature sensor, pressure sensor, or magnetic sensor) of user device 603. As shown, the STB 601 comprises one or more modules of the platform 101, as illustrated in FIGS. 1 and 2.

STB 601 may comprise computing hardware (such as described with respect to FIGS. 8 and 9) and include additional components configured to provide services. In addition, STB 601 includes hardware and/or other components to support related functions and capabilities for viewing video assets (e.g., remote control capabilities, conditional access functions, tuning functions, presentation functions, multiple network interfaces, audio/video signal ports, etc.). As shown in FIG. 6, the functions and operations of STB 601 may be governed by a controller 607, which interacts with a media stream decoder 608. Additionally, controller 607 interacts with each of the STB components to provide programming guide information (e.g., EPG) and related content retrieved from an audio or video-sharing site, as well as from another STB device or component of system 100. In turn, the user may be afforded greater functionality utilizing a control device 609 to control the personalized programming guide service and related services, as will be more fully described below.

STB 601 may be configured to communicate with a number of user devices, including: a PC 611, laptops, PDAs, cellular phones (e.g., device 603), mobile devices, handheld devices, as well as any other equivalent technology capable of capturing and storing media.

As such, STB 601 may be configured to provide an indicator that the STB 601 is being controlled by the mobile unit 603 on (or at) display 615. In one embodiment, presentation of the media information (or content) may include: displaying, recording, playing, rewinding, forwarding, toggling, selecting, zooming, or any other processing technique that enables users to manipulate the media. For instance, STB 601 may provide one or more signals to the display 615 (e.g., television) so that the display 615 may present the media, as images, audio, video, or any combination thereof. A communication interface (not illustrated) of PC 611 may be configured to retrieve the programming and content information over the data network (e.g., data network 109), wherein STB 601 may receive a programming content stream from PC 611 to present to the user via display 615.

STB 601 may also interact with a PVR, such as digital video recorder (DVR) 619, to store received content that can then be manipulated by a user at a later point in time. In various embodiments, DVR 619 may be network-based, e.g., included as a part of the service provider network 115, collocated at a subscriber site having connectivity to STB 601, and/or integrated into STB 601.

Furthermore, STB 601 may include a communication interface 625 configured to receive content streams from a programming service provider, PC 611, server (not shown), or other programming content source, such as content provider systems 125. Communication interface 625 may optionally include single or multiple port interfaces. For example, STB 601 may establish a broadband connection to multiple sources transmitting content to STB 601 via a single port, whereas in alternative embodiments, multiple ports may be assigned to the one or more sources. In still other embodiments, communication interface 625 may be configured to permit users, via STB 601, to transmit data (including media content) to other users with STBs, a programming service provider 115, or other content source/sink.

According to various embodiments, STB 601 may also include inputs/outputs (e.g., connectors 627) to display 615 and DVR 619, as well as an audio system 629. In particular, audio system 629 may comprise a conventional audio-video receiver capable of monaural or stereo sound, as well as multichannel surround sound. Audio system 629 may include speakers, ear buds, headphones, or any other suitable component configured for personal or public dissemination. As such, STB 601, display 615, DVR 619, and audio system 629, for example, may support high resolution audio and/or video streams, such as high definition television (HDTV) or digital theater systems high definition (DTS-HD) audio. Thus, STB 601 may be configured to encapsulate data into a proper format with required credentials before transmitting onto one or more of the networks of FIG. 1 and de-encapsulate incoming traffic to dispatch data to display 615 and/or audio system 629.

In an exemplary embodiment, display 615 and/or audio system 629 may be configured with internet protocol (IP) capability (i.e., includes an IP stack, or is otherwise network addressable), such that the functions of STB 601 may be assumed by display 615 and/or audio system 629. In this manner, an IP ready, HDTV display or DTS-HD audio system may be directly connected to one or more service provider networks 115, packet-based networks (e.g., 109), and/or telephony networks 111. Although STB 601, display 615, DVR 619, and audio system 629 are shown separately, it is contemplated that these components may be integrated into a single component, or other combination of components.

Authentication module 633 with STB 601 may also be responsible for detecting and authenticating one or more user devices 603. Additionally, authentication module 633 may be provided to initiate or respond to authentication schemes of, for instance, service provider network 115 or various other content providers, e.g., broadcast television systems, (third-party) content provider systems 125. Authentication module 633 may provide sufficient authentication information, e.g., a user name and password, a key access number, a unique machine identifier (e.g., MAC address), and the like, as well as combinations thereof, to a corresponding network interface for establishing connectivity. As described earlier, one or more digital certificates may be simultaneously mapped. Moreover, authentication at STB 601 may identify and authenticate a second device (e.g., PC 611) communicatively coupled to, or associated with, STB 601, or vice versa. Further, authentication information may be stored locally at memory 631, in a repository (not shown) connected to STB 601, or at a remote repository, e.g., a user profile repository.

Authentication module 633 may also facilitate the reception of data from single or disparate sources. For instance, STB 601 may receive broadcast video from a first source (e.g., program service provider), signals from a second source, and a programming content stream from a third source accessible over a data network. As such, display 615 may present the broadcast video and programming content stream to the user. This presentation may be experienced separately, concurrently, in a toggled fashion, or with zooming, maximizing, minimizing, or trick capabilities, or equivalent mode.

Connector(s) 627 may provide various physical interfaces to display 615, audio system 629, as well as other peripherals; the physical interfaces may include, for example, RJ45, RJ11, high definition multimedia interface (HDMI), optical, coax, FireWire®, wireless, and universal serial bus (USB), or any other suitable connector. The presentation module 635 may also interact with a control device 609 for determining particular media content that a user desires to experience. In an exemplary embodiment, the control device 609 may comprise a remote control (or other access device having control capability, such as a PC 611, wireless device, mobile phone, etc.) that provides a user with the ability to readily manipulate and dynamically change parameters affecting the device event-based STB control service. In other examples, STB 601 may be configured for voice recognition such that STB 601 may be controlled with spoken utterances.

In addition to the user device 603 being configured to control the manner in which STB 601 behaves in response to device events, STB 601 may also permit control device 609 to activate and deactivate the device event-based STB control service. In this manner, control device 609 may include (not shown) a cursor controller, trackball, touch screen, touch pad, keyboard, and/or a key pad for activating a slideshow application, selecting programming content, as well as performing other control functions. Control device 609 may also include functional actuators (e.g., buttons, keys, icons, etc.), such as power on/of, play, pause, stop, fast-forward, reverse, volume up/down, channel up/down, menu, ok/enter, record, info, my content, search, edit, or exit, as well as any other suitable control trigger, such as alphanumeric buttons, shift, control, back, symbols, and the like.

Further, the control device 609 may comprise a memory (not illustrated) for storing preferences relating the device event-based STB control service; such preferences can be conveyed to STB 601 through an input interface 637. The input interface 637 may support any type of wired and/or wireless link, e.g., infrared, radio frequency (RF), BLUETOOTH™, and the like. Thus, control device 609 may store user preferences with respect to the parameters associated with the device event-based STB control service. Alternatively, user preferences may be tracked, recorded, or stored in STB 601 or in a network user profile repository. The preferences may be automatically retrieved and activated by a user at any time. It is noted that the control device 609 may be separate from STB 601 or may be integrated within STB 601 (in which case certain input interface hardware and/or software may not be necessary).

Figure 7:
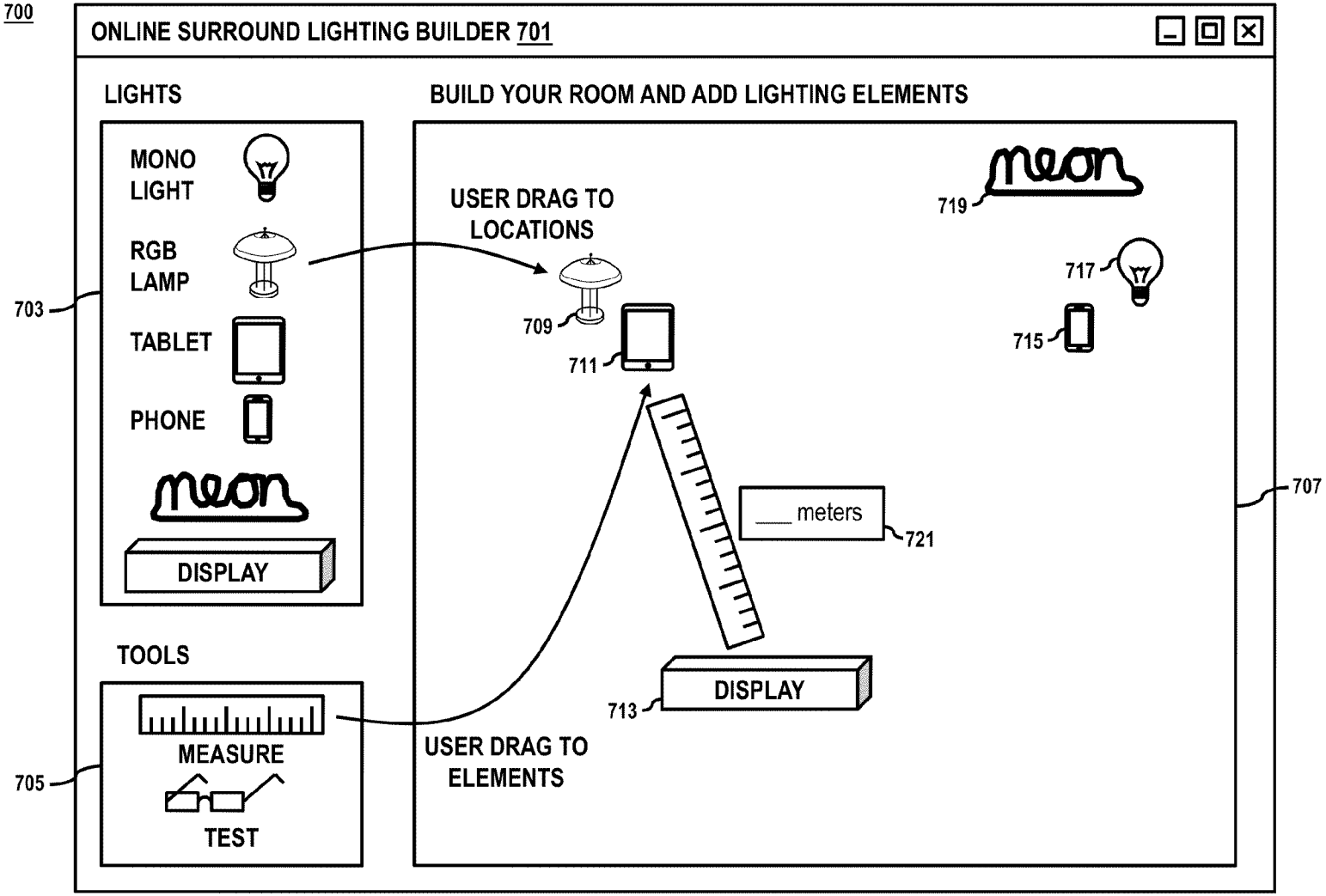
FIG. 7 is a diagram of a graphical user interface (GUI) presented via a set-top box for providing a network based surround-light environment, according to one embodiment.

FIG. 7 is a diagram of a graphical user interface (GUI) presented via a set-top box for providing a network based surround-light environment, according to one embodiment. GUI 700 may be evoked using a number of different methods. For example, a user may select a dedicated "SCENE" button on control device 609 or a peripheral device communicatively coupled thereto, such as computing device 117, a mobile handset (not shown), and the like. It is recognized that any other suitable actuator of these devices may be additionally, or alternatively, used to access the functionality of scene 701, such as triggering a "SCENE" icon. Further, scene 701 may be evoked by selecting an option within another interface or application, such as, for example, when navigating from a public screen (or navigational shell) to a user-specific screen, i.e., a private screen. As such, an executing device may require sufficient authentication information (e.g., username and password, etc.) to be input in order to access the functions of GUI 700.

As illustrated in FIG. 7, GUI 700 includes interactive viewing panes 703, 705, and 707. In particular embodiments, as will be described in more detail below, the content of panes 703 through 707 may be dynamically updated to display various menu options, interaction elements, information, etc., related to user interaction within each of the respective panes 703 through 707, and vice versa. In this example, pane 703 includes a listing of selectable illuminating elements that may be provided to a scene. Such selectable illuminating elements may be entered or otherwise configured by a user and/or included as a predefined illuminating element type. For example, such entries may include a monochromatic light "mono light," (e.g., incandescent table lamp 411), RGB lamp (e.g., 407), tablet (e.g., 413), phone (e.g., 415), neon light (e.g, 405), and a main display (e.g., 403). Further, a user may input a drag-drop function to position a particular entry from pane 703 into pane 707. As shown, pane 707 includes RGB lamp 709, tablet 711, display 713, phone 715, mono light 717, and neon light 719. It is noted that other items may be displayed, for instance, a sofa or couch, coffee table, etc., in pane 707.

Some embodiments include a predefined lighting layout. For example, a common or frequently used scene may be presented to allow users to simply modify or customize a predefined lighting layout presented in pane 707. Additionally, or alternatively, a user creates a lighting layout and subsequently retrieves the lighting layout from a network and/or cloud based log (e.g., log 123) and/or log of STB 103.

Moreover, the pane 705 includes selectable options to input a measurement of a location of an illuminating element relative to the display 713 and to detect an illumination of an illuminating element. In one embodiment, a measurement between an illuminating element and display 713 is input by a user by performing a drag-drop function of a particular selectable option onto a particular illuminating element. By way of example, a user drags the "measure" selectable option from the pane 705 and drops it on the tablet 711 to cause the GUI 700 to present a prompt 721 for entering a measurement between the table 711 and display 713.

Furthermore, in one embodiment, a test of an illuminating and display 713 is initiated by a user by performing a selection of a "test" selectable option in pane 705 and a selection of a one or more respective illuminating elements of pane 707 to test. By way of example, a user selects the "test" selectable option from the pane 705 and selects the neon light 719, which causes the phone 715 to present a user interface requesting the user to position the phone 715 such that a built-in camera can directly detect an illumination of neon light 719. As such, the GUI 700 can facilitate a detection of lighting characteristics (e.g., a color) of illuminating elements.

The processes described herein for providing a network based surround-light environment may be implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

FIG. 8 is a diagram of a computer system that can be used to implement various exemplary embodiments. The computer system 800 includes a bus 801 or other communication mechanism for communicating information and a processor 803 coupled to the bus 801 for processing information. The computer system 800 also includes main memory 805, such as random access memory (RAM) or other dynamic storage device, coupled to the bus 801 for storing information and instructions to be executed by the processor 803. Main memory 805 also can be used for storing temporary variables or other intermediate information during execution of instructions by the processor 803. The computer system 800 may further include a read only memory (ROM) 807 or other static storage device coupled to the bus 801 for storing static information and instructions for the processor 803. A storage device 809, such as a magnetic disk or optical disk, is coupled to the bus 801 for persistently storing information and instructions.

The computer system 800 may be coupled via the bus 801 to a display 811, such as a cathode ray tube (CRT), liquid crystal display, active matrix display, or plasma display, for displaying information to a computer user. An input device 813, such as a keyboard including alphanumeric and other keys, is coupled to the bus 801 for communicating information and command selections to the processor 803. Another type of user input device is a cursor control 815, such as a mouse, a trackball, or cursor direction keys, for communicating direction information and command selections to the processor 803 and for controlling cursor movement on the display 811.

According to certain embodiments, the processes described herein are performed by the computer system 800, in response to the processor 803 executing an arrangement of instructions contained in main memory 805. Such instructions can be read into main memory 805 from another computer-readable medium, such as the storage device 809. Execution of the arrangement of instructions contained in main memory 805 causes the processor 803 to perform the process steps described herein. One or more processors in a multi-processing arrangement may also be employed to execute the instructions contained in main memory 805. In alternative embodiments, hard-wired circuitry may be used in place of or in combination with software instructions to implement the embodiment of the invention. Thus, embodiments of the invention are not limited to any specific combination of hardware circuitry and software.

The computer system 800 also includes a communication interface 817 coupled to bus 801. The communication interface 817 provides a two-way data communication coupling to a network link 819 connected to a local network 821. For example, the communication interface 817 may be a digital subscriber line (DSL) card or modem, an integrated services digital network (ISDN) card, a cable modem, a telephone modem, or any other communication interface to provide a data communication connection to a corresponding type of communication line. As another example, communication interface 817 may be a local area network (LAN) card (e.g. for Ethernet™ or an Asynchronous Transfer Model (ATM) network) to provide a data communication connection to a compatible LAN. Wireless links can also be implemented. In any such implementation, communication interface 817 sends and receives electrical, electromagnetic, or optical signals that carry digital data streams representing various types of information. Further, the communication interface 817 can include peripheral interface devices, such as a Universal Serial Bus (USB) interface, a PCMCIA (Personal Computer Memory Card International Association) interface, etc. Although a single communication interface 817 is depicted in FIG. 8, multiple communication interfaces can also be employed.

The network link 819 typically provides data communication through one or more networks to other data devices. For example, the network link 819 may provide a connection through local network 821 to a host computer 823, which has connectivity to a network 825 (e.g. a wide area network (WAN) or the global packet data communication network now commonly referred to as the "Internet") or to data equipment operated by a service provider. The local network 821 and the network 825 both use electrical, electromagnetic, or optical signals to convey information and instructions. The signals through the various networks and the signals on the network link 819 and through the communication interface 817, which communicate digital data with the computer system 800, are exemplary forms of carrier waves bearing the information and instructions.

The computer system 800 can send messages and receive data, including program code, through the network(s), the network link 819, and the communication interface 817. In the Internet example, a server (not shown) might transmit requested code belonging to an application program for implementing an embodiment of the invention through the network 825, the local network 821 and the communication interface 817. The processor 803 may execute the transmitted code while being received and/or store the code in the storage device 809, or other non-volatile storage for later execution. In this manner, the computer system 800 may obtain application code in the form of a carrier wave.

The term "computer-readable medium" as used herein refers to any medium that participates in providing instructions to the processor 803 for execution. Such a medium may take many forms, including but not limited to non-volatile media, volatile media, and transmission media. Non-volatile media include, for example, optical or magnetic disks, such as the storage device 809. Volatile media include dynamic memory, such as main memory 805. Transmission media include coaxial cables, copper wire and fiber optics, including the wires that comprise the bus 801. Transmission media can also take the form of acoustic, optical, or electromagnetic waves, such as those generated during radio frequency (RF) and infrared (IR) data communications. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Various forms of computer-readable media may be involved in providing instructions to a processor for execution. For example, the instructions for carrying out at least part of the embodiments of the invention may initially be borne on a magnetic disk of a remote computer. In such a scenario, the remote computer loads the instructions into main memory and sends the instructions over a telephone line using a modem. A modem of a local computer system receives the data on the telephone line and uses an infrared transmitter to convert the data to an infrared signal and transmit the infrared signal to a portable computing device, such as a personal digital assistant (PDA) or a laptop. An infrared detector on the portable computing device receives the information and instructions borne by the infrared signal and places the data on a bus. The bus conveys the data to main memory, from which a processor retrieves and executes the instructions. The instructions received by main memory can optionally be stored on storage device either before or after execution by processor.

FIG. 9 is a diagram of a chip set that can be used to implement various exemplary embodiments. Chip set 900 is programmed to provide a network based surround-light environment to dynamically drive lighting scenes as described herein and includes, for instance, the processor and memory components described with respect to FIG. 8 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip. Chip set 900, or a portion thereof, constitutes a means for performing one or more steps of FIGS. 3 and 5.

In one embodiment, the chip set 900 includes a communication mechanism such as a bus 901 for passing information among the components of the chip set 900. A processor 903 has connectivity to the bus 901 to execute instructions and process information stored in, for example, a memory 905. The processor 903 may include one or more processing cores with each core configured to perform independently. A multi-core processor enables multiprocessing within a single physical package. Examples of a multi-core processor include two, four, eight, or greater numbers of processing cores. Alternatively or in addition, the processor 903 may include one or more microprocessors configured in tandem via the bus 901 to enable independent execution of instructions, pipelining, and multithreading. The processor 903 may also be accompanied with one or more specialized components to perform certain processing functions and tasks such as one or more digital signal processors (DSP) 907, or one or more application-specific integrated circuits (ASIC) 909. A DSP 907 typically is configured to process real-world signals (e.g., sound) in real time independently of the processor 903. Similarly, an ASIC 909 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 903 and accompanying components have connectivity to the memory 905 via the bus 901. The memory 905 includes both dynamic memory (e.g., RAM, magnetic disk, writable optical disk, etc.) and static memory (e.g., ROM, CD-ROM, etc.) for storing executable instructions that when executed perform the inventive steps described herein to provide a network based surround-light environment. The memory 905 also stores the data associated with or generated by the execution of the inventive steps.

While certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A method comprising:

determining location information of one or more illuminating elements relative to a display for presenting media information;

determining lighting characteristic information for the one or more illuminating elements;

determining, by a processor, a lighting profile for illuminating the one or more illuminating elements based on the location information and lighting characteristic information; and determining a color range, maximum lumen intensity, delay of reaction, or combination thereof for at least one of the one or more illuminating elements, wherein the lighting characteristic information is based on the color range, maximum lumen intensity, delay of reaction, or combination thereof.

2. The method according to claim 1, further comprising:

initiating a detection of an illumination of one of the one or more illuminating elements, wherein the color range, maximum lumen intensity, delay of reaction, or combination thereof is based on the detected illumination.

3. The method according to claim 1, further comprising:

initiating an input of an indication of a selection of a predefined color range, maximum lumen intensity, delay of reaction, or a combination thereof, wherein the color range, maximum lumen intensity, delay of reaction, or a combination thereof is based on the input.

4. A method comprising:

determining location information of one or more illuminating elements relative to a display for presenting media information;

determining lighting characteristic information for the one or more illuminating elements;

determining, by a processor, a lighting profile for illuminating the one or more illuminating elements based on the location information and lighting characteristic information;

determining one or more lighting parameters for illumination of the one or more illuminating elements based on the media information and the lighting profile, wherein the media information includes a video, an image, audio, a telephone connection, or a combination thereof;

sampling an image and/or audio signal of a presentation of the media information, the presentation being associated, at least in part, with the display; and determining a mapping of the sampled image and/or audio signal, wherein the one or more lighting parameters are further based on the mapping.

5. The method according to claim 4, further comprising:

sampling another image and/or audio signal of the presentation of the media information;

determining another mapping of the other sampled image and/or audio signal;

comparing the mapping with the other mapping; and determining a time weighted average, change in intensity, color graduation, global screen shift, or combination thereof based on the comparison, wherein the one or more lighting parameters are further based on the time weighted average, change in intensity, color graduation, global screen shift, or combination thereof.

6. A method comprising:

determining location information of one or more illuminating elements relative to a display for presenting media information;

determining lighting characteristic information for the one or more illuminating elements;

determining, by a processor, a lighting profile for illuminating the one or more illuminating elements based on the location information and lighting characteristic information;

determining one or more lighting parameters for illumination of the one or more illuminating elements based on the media information and the lighting profile, wherein the one or more lighting parameters indicate a color, lumen intensity, a delay of reaction, or a combination thereof, and the one or more illuminating elements are associated with a mobile telephone, laptop, tablet computer, internet protocol enabled light-emitting diode (IP LED), or a combination thereof; and initiating an illumination of at least one of the one or more illuminating elements according to the one or more lighting parameters.

7. An apparatus comprising:

at least one processor; and at least one memory including computer program code, the at least one memory and the computer program code configured to, with the at least one processor, cause the apparatus to perform at least the following, determine location information of one or more illuminating elements relative to a display for presenting media information;

determine lighting characteristic information for the one or more illuminating elements;

determine a lighting profile for illuminating the one or more illuminating elements based on the location information and lighting characteristic information; and determine a color range, maximum lumen intensity, delay of reaction, or combination thereof for at least one of the one or more illuminating elements, wherein the lighting characteristic information is based on the color range, maximum lumen intensity, delay of reaction, or combination thereof.

8. The apparatus according to claim 7, wherein the apparatus is further caused to:

initiate a detection of an illumination of one of the one or more illuminating elements, wherein the color range, maximum lumen intensity, delay of reaction, or combination thereof is based on the detected illumination.

9. The apparatus according to claim 7, wherein the apparatus is further caused to:

initiate an input of an indication of a selection of a predefined color range, maximum lumen intensity, delay of reaction, or a combination thereof, wherein the color range, maximum lumen intensity, delay of reaction, or a combination thereof is based on the input.

10. An apparatus comprising:

at least one processor; and at least one memory including computer program code, the at least one memory and the computer program code configured to, with the at least one processor, cause the apparatus to perform at least the following, determine location information of one or more illuminating elements relative to a display for presenting media information;

determine lighting characteristic information for the one or more illuminating elements;

determine a lighting profile for illuminating the one or more illuminating elements based on the location information and lighting characteristic information;

determine one or more lighting parameters for illumination of the one or more illuminating elements based on the media information and the lighting profile, wherein the media information includes a video, an image, audio, a telephone connection, or a combination thereof;

sample an image and/or audio signal of a presentation of the media information, the presentation being associated, at least in part, with the display; and determine a mapping of the sampled image and/or audio signal, wherein the one or more lighting parameters are further based on the mapping.

11. The apparatus according to claim 10, wherein the apparatus is further caused to:

sample another image and/or audio signal of the presentation of the media information;

determine another mapping of the other sampled image and/or audio signal;

compare the mapping with the other mapping; and determine a time weighted average, change in intensity, color graduation, global screen shift, or combination thereof based on the comparison, wherein the one or more lighting parameters are further based on the time weighted average, change in intensity, color graduation, global screen shift, or combination thereof.

12. An apparatus comprising:

at least one processor; and at least one memory including computer program code, the at least one memory and the computer program code configured to, with the at least one processor, cause the apparatus to perform at least the following, determine location information of one or more illuminating elements relative to a display for presenting media information;

determine lighting characteristic information for the one or more illuminating elements;

determine a lighting profile for illuminating the one or more illuminating elements based on the location information and lighting characteristic information;

determine one or more lighting parameters for illumination of the one or more illuminating elements based on the media information and the lighting profile, wherein the one or more lighting parameters indicate a color, lumen intensity, a delay of reaction, or a combination thereof, and the one or more illuminating elements are associated with a mobile telephone, laptop, tablet computer, internet protocol enabled light-emitting diode (IP LED), or a combination thereof; and initiate an illumination of at least one of the one or more illuminating elements according to the one or more lighting parameters.

13. A method comprising:

determining location information of one or more illuminating elements relative to a display for presenting media information, wherein the one or more illuminating elements are associated with a mobile telephone, laptop, tablet computer, internet protocol enabled light-emitting diode (IP LED), or a combination thereof and the media information includes a video, an image, audio, a telephone connection, or a combination thereof;

determining lighting characteristic information for the one or more illuminating elements, the lighting characteristic information including a color range, maximum lumen intensity, delay of reaction, or combination thereof for at least one of the one or more illuminating elements;

determining a lighting profile for illuminating the one or more illuminating elements based on the location information and lighting characteristic information;

determining, by a set-top box, one or more lighting parameters for illumination of the one or more illuminating elements based on the lighting profile and the media information, the one or more lighting parameters including a color, lumen intensity, a delay of reaction, or a combination thereof for at least one of the one or more illuminating elements; and initiating an illumination of at least one of the one or more illuminating elements according to the one or more lighting parameters.

14. The method according to claim 13, further comprising:

sampling an image and/or audio signal of a presentation of the media information, the presentation being associated, at least in part, with the display;

determining a mapping of the sampled image and/or audio signal;

sampling another image and/or audio signal of the presentation of the media information;

determining another mapping of the other sampled image and/or audio signal;

comparing the mapping with the other mapping; and determining a time weighted average, change in intensity, color graduation, global screen shift, or combination thereof based on the comparison, wherein the one or more lighting parameters are further based on the time weighted average, change in intensity, color graduation, global screen shift, or combination thereof.

15. The method according to claim 13, further comprising at least one of the following:

initiating a detection of an illumination of one of the one or more illuminating elements, wherein the color range, maximum lumen intensity, delay of reaction, or combination thereof associated with the one illuminating element is based on the detected illumination; and initiating an input of an indication of a selection of a predefined color range, maximum lumen intensity, delay of reaction, or a combination thereof, wherein the color range, maximum lumen intensity, delay of reaction, or a combination thereof is based on the input.

16. A set-top box device comprising:

a processor configured to:

determine location information of one or more illuminating elements relative to a display for presenting media information, wherein the one or more illuminating elements are associated with a mobile telephone, laptop, tablet computer, internet protocol enabled light-emitting diode (IP LED), or a combination thereof and the media information includes a video, an image, audio, a telephone connection, or a combination thereof;

determine lighting characteristic information for the one or more illuminating elements, the lighting characteristic information including a color range, maximum lumen intensity, delay of reaction, or combination thereof for at least one of the one or more illuminating elements;

determine a lighting profile for illuminating the one or more illuminating elements based on the location information and lighting characteristic information;

determine one or more lighting parameters for illumination of the one or more illuminating elements based on the lighting profile and the media information, the one or more lighting parameters including a color, lumen intensity, a delay of reaction, or a combination thereof for at least one of the one or more illuminating elements; and initiate illumination of at least one of the one or more illuminating elements according to the one or more lighting parameters; and a memory configured to store the lighting profile.

17. The set-top box device according to claim 16, wherein the processor is further configured to:

sample an image and/or audio signal of a presentation of the media information, the presentation being associated, at least in part, with the display;

determine a mapping of the sampled image and/or audio signal;

sample another image and/or audio signal of the presentation of the media information;

determine another mapping of the other sampled image and/or audio signal;

compare the mapping with the other mapping; and determine a time weighted average, change in intensity, color graduation, global screen shift, or combination thereof based on the comparison, wherein the one or more lighting parameters are further based on the time weighted average, change in intensity, color graduation, global screen shift, or combination thereof.

18. The set-top box device according to claim 16, wherein the processor is further configured to:

initiate a detection of an illumination of one of the one or more illuminating elements and/or initiate an input of an indication of a selection of a predefined color range, maximum lumen intensity, delay of reaction, or a combination thereof, wherein the color range, maximum lumen intensity, delay of reaction, or a combination thereof is based on the detected illumination and/or input.

* * * * *